United States Patent [19]

Yant

[11] Patent Number: 4,704,046

[45] Date of Patent: Nov. 3, 1987

[54] PAVEMENT PATCHING VEHICLE

[76] Inventor: Robert M. Yant, P.O. Box 28434, Sacramento, Calif. 95828

[21] Appl. No.: 800,474

[22] Filed: Nov. 21, 1985

[51] Int. Cl.[4] ..... E01C 19/18

[52] U.S. Cl. ..... 404/109; 404/110; 74/89.21

[58] Field of Search ..... 404/101, 108–111, 404/113, 92; 74/89.2, 89.21, 89.22, 108

[56] References Cited

U.S. PATENT DOCUMENTS

| | | | |
|---|---|---|---|
| 1,629,300 | 5/1927 | Petersen | 74/108 X |
| 1,931,793 | 10/1933 | Gleason | 404/111 X |
| 2,041,350 | 5/1936 | Johnson | 404/101 |
| 2,297,813 | 10/1942 | Stork | 474/210 X |
| 3,217,620 | 11/1965 | Mindrum et al. | 404/108 X |
| 3,363,523 | 1/1968 | Brock et al. | 404/113 X |
| 3,967,913 | 7/1976 | Gabriel, Jr. | 404/109 |
| 4,196,827 | 4/1980 | Leafdale | 404/111 X |
| 4,215,949 | 8/1980 | Gabriel, Jr. | 404/110 |
| 4,557,626 | 12/1985 | McKay et al. | 404/108 X |

FOREIGN PATENT DOCUMENTS

| | | | |
|---|---|---|---|
| 1315151 | 4/1973 | United Kingdom | 404/109 |

*Primary Examiner*—Stephen J. Novosad
*Assistant Examiner*—John F. Letchford
*Attorney, Agent, or Firm*—Townsend and Townsend

[57] ABSTRACT

An improved pavement patching vehicle includes a movable distribution hopper and a supply hopper having an opening for discharging patching material into an underlying distribution hopper. The supply hopper, heated by catalytic radiant panels, includes a bottom, sidewalls and a pivotal hood. The supply hopper is mounted to the vehicle by a pair of lift arms and a pair of support arms. The lift arms are secured to a common lift shaft mounted to the vehicle parallel to the vehicle axis. The lift shaft is driven by a single piston and cylinder combination mounted generally parallel to the vehicle axis through a gear drive. This drive is compact due to positioning of the piston and cylinder combination.

21 Claims, 6 Drawing Figures

PAVEMENT PATCHING VEHICLE

BACKGROUND OF THE INVENTION

The need for a pavement patching vehicle has been recognized for a number of years. See U.S. Pat. No. 4,215,949 to Gabriel, Jr. The Gabriel patent shows a vehicle having a supply hopper mounted along one side. The supply hopper, used to hold a quantity of asphalt, can be lowered to allow a dump truck to dump asphalt or other patching material into it through its open top. After this is done, the supply hopper is lifted to a raised position for transport and use.

The Gabriel vehicle has a distribution hopper mounted to the end of a remotely controlled arm extending from the front of the vehicle. The arm has a pair of articulated joints which allow the hopper to be positioned over a range of positions by the vehicle operator. The distribution hopper, which has an open top, is filled by placing it under the forward end of the supply hopper. The supply hopper has an auger in it which drives the asphalt forward to be discharged through a downwardly facing opening and into the underlying distribution hopper. The asphalt in the supply hopper is kept warm by the use of a flame inside the auger tube.

After being filled, the operator of the Gabriel vehicle moves the distribution hopper over an area to be repaired and remotely operates a door at the bottom of the distribution hopper, allowing a desired amount of asphalt to be deposited onto the roadway. A remotely controlled tamper, mounted to the distribution hopper, tamps the asphalt in place.

SUMMARY OF THE INVENTION

The present invention is directed to an improved pavement patching vehicle of the type including a movable distribution hopper and a supply hopper, mounted to the vehicle for containing a supply of paving material, such as asphalt. The supply hopper discharges paving material into an underlying distribution hopper. The sidewalls of the supply hopper are preferably heated by catalytic radiant panels. A hood covers the supply hopper to help conserve heat and also has radiant panels mounted to it to heat the paving material. The supply hopper is mounted to the vehicle by lift arms. Preferably, a pair of upper lift arms and a pair of lower support arms are used.

The lift arms are secured to a common lift shaft, the lift shaft being driven by a single piston and cylinder. The piston and cylinder is preferably mounted transversely to the arms so to be generally parallel to the vehicle axis. The piston and cylinder drives a gear which is coupled to the lift shaft by a lift chain. The lift chain engages, typically, a gear segment secured to the lift shaft. Since the gear segment is in a plane generally perpendicular to the plane of the drive gear, the chain passes an idler to change direction. To accommodate this change in direction, the chain includes at least one multi-flexion link to allow the chain to flex in one plane at one end and at another plane at its other end.

The drive arrangement is compact since the piston and cylinder are positioned generally parallel to the axis of the vehicle, rather than generally perpendicular as would be otherwise the case if a piston and cylinder arrangement were to raise and lower the supply hopper in a more direct manner.

One of the advantages of the invention is its use of radiant heat panels, preferably of the catalytic type, instead of a direct flame approach. The radiant heat panels are much safer since adjustments are not as critical as they would be with apparatus using a relatively large flame as a source of heat. The panels provide heat at a somewhat lower temperature than exists with direct flame methods but over a relatively large area for more uniform temperature control of the entire mass of asphalt within the supply hopper.

Another advantage of the invention is the use of the particular drive arrangement for raising and lowering the supply hopper. By positioning the cylinder and piston generally parallel to the lift arm and vehicle axes, and thus generally perpendicular to the lift and support arms, the lifting apparatus is quite compact since the stroke of the piston is generally parallel to the vehicle axis rather than perpendicular to it.

Preferably a pair of augers, having spiral flights wound in opposite directions, are used to move the paving material to the supply hopper's discharge opening. Doing so, and rotating the augers in opposite rotary directions, both feeds the asphalt to the discharge opening and also helps to mix the asphalt within the supply hopper.

Preferably two lift chains are used to drive the lift shaft, the chains wound about the lift shaft in both rotary directions. Therefore, the lift shaft is positively driven in both rotary directions when both raising and lowering the supply hopper. This is important since it permits the supply hopper to be raised to a position in which the lift arms are past the vertical so the supply hopper is past top dead center. Such a position is an inherently stable position since to move the supply hopper back to a lowered position, the supply hopper must be lifted up; therefore its own weight helps keep it in place.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
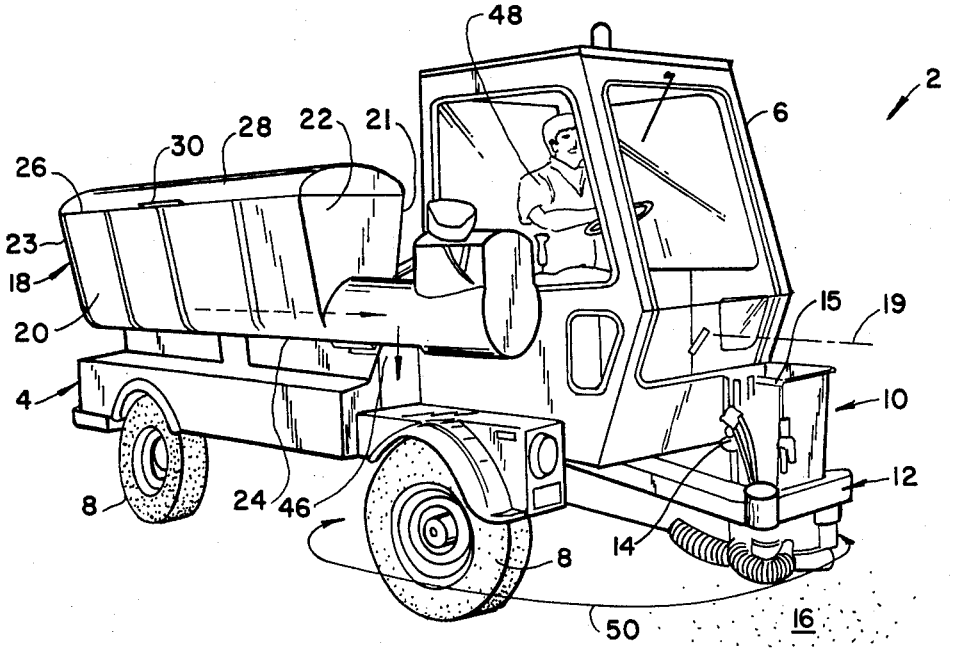
FIG. 1 is a perspective view of the improved pavement patching vehicle of the invention with the supply hopper in a raised, use position.
Figure 2:
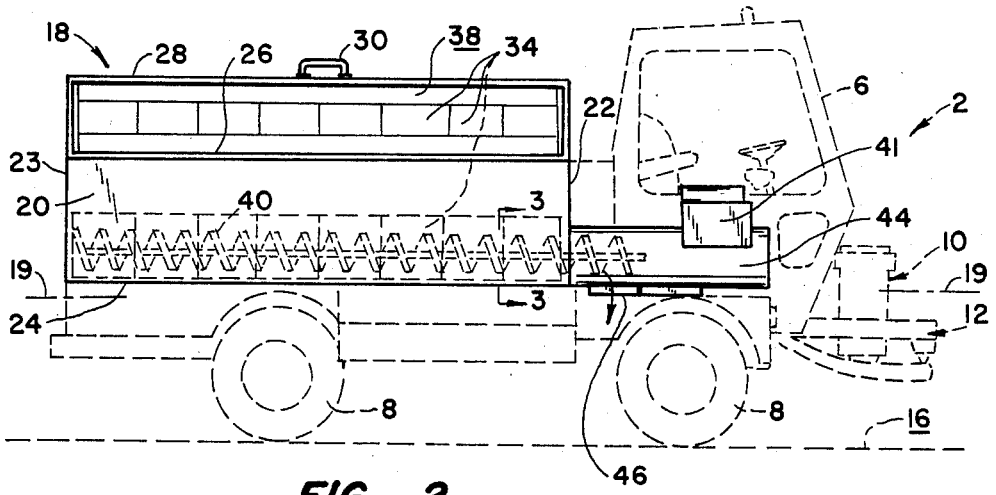
FIG. 2 is a side view of the vehicle of FIG. 1 with the hood of the supply hopper partly raised, the balance of the vehicle, the radiant panels and the auger shown in dashed lines.
Figure 3:
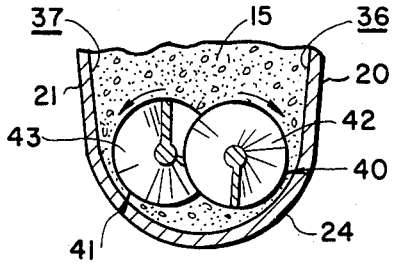
FIG. 3 is a cross-sectional view of a portion of the supply hopper taken along line 3—3 of FIG. 2.

Turning now to FIGS. 1 and 2, an asphalt patching vehicle 2 is shown to include a vehicle body 4 having a cab 6 and four wheels 8. An asphalt distribution hopper 10 is mounted to body 4 below cab 6 by an articulated arm 12. A tamper 14 is mounted to hopper 10 for the remote controlled compaction of asphalt 15 or other paving material discharged from distribution hopper 10 onto surface 16, typically a roadway. A supply hopper 18 is mounted to body 4 along one side of the body generally parallel to the vehicle axis 19. Supply hopper 18 includes elongate, downwardly and inwardly tapering sides 20, 21 and generally vertical ends 22, 23 extending between a bottom 24, shown also in FIG. 3, and an upper edge 26. A hood 28, having a handle 30, is pivotally mounted to the upper edge 26 of side 20.

The use of hood 28 helps to keep paving material 15 at an elevated temperature while contained in supply hopper 18. As a further aid to keep the temperature of material 15 elevated, a number of catalytic radiant panels 34, such as those sold by Gbruest Industries of Independence, Kansas, are mounted to the inside surfaces 36, 37 of sides 20, 21 and on the underside 38 of hood 28.

A pair of augers 40 are mounted within supply hopper 18 just above bottom 24. Augers 40 have flights 42, 43 which wrap in opposite rotary directions. Augers 40 are rotated in opposite rotary directions by a drive 41 mounted to an extension 44 of hopper 18 extending from front end 22. Extension 44 has a discharge opening 46 along its bottom for the discharge of paving material 15 into distribution hopper 10, distribution hopper 10 having been positioned beneath opening 46 by the operator 48 manipulating arm 12. This movement is indicated by arrow 50 in FIG. 1. The use of a pair of augers 40 moves paving material 15 towards discharge opening 46 also helps to keep the paving material mixed within supply hopper 18.

Figure 4:
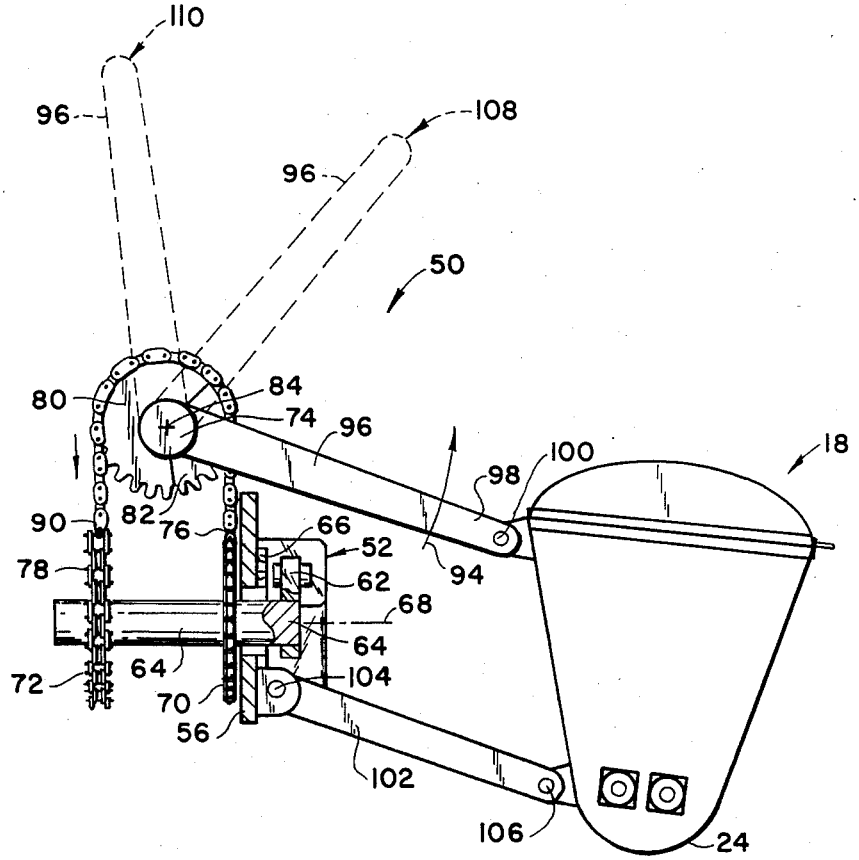
FIG. 4 is a simplified end view of the supply hopper and the movable mounting apparatus.
Figure 5:
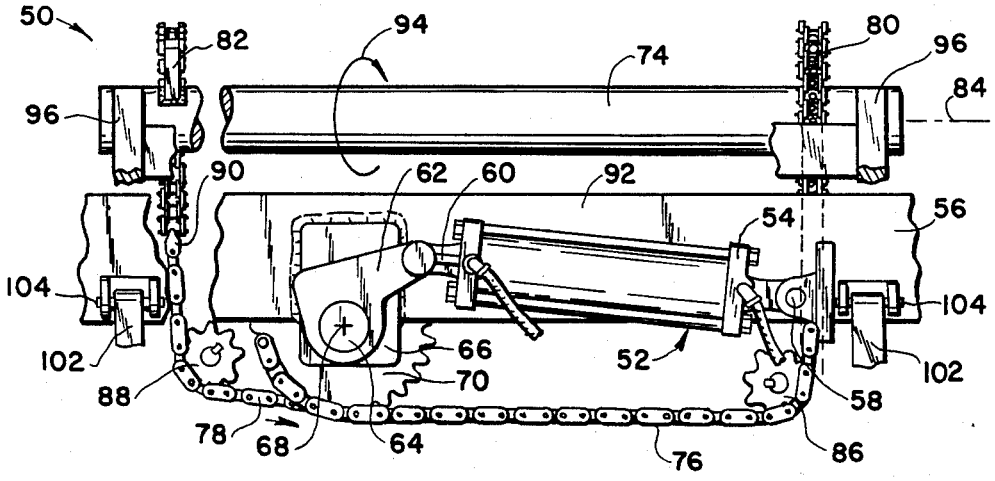
FIG. 5 is a side view of the movable mounting apparatus of FIG. 4.
Figure 6:
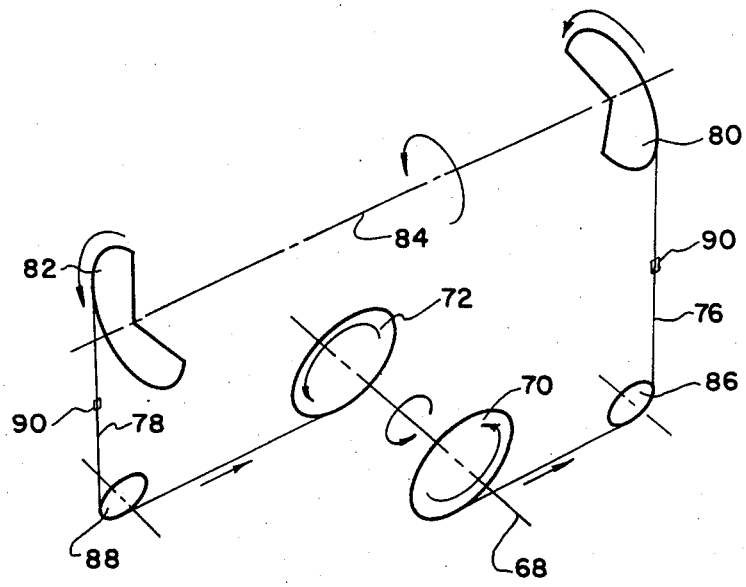
FIG. 6 is a schematic perspective view showing the movement of the chains of FIGS. 4 and 5.

Referring now to FIGS. 4 and 5, supply hopper mounting apparatus 50 is shown. Apparatus 50 includes a hydraulic piston and cylinder combination 52, hereafter called ram 52, pivotally mounted at one end 54 to a longitudinal frame member 56 of body 4 at pivot 58. Ram 52 includes a push rod 60 connected to a crank arm 62. Crank arm 62 is fixed to a drive shaft 64. Shaft 64 is journaled within a bearing block 66 welded to frame member 56 for rotation about drive axis 68, drive axis 68 being perpendicular to a vertical plane passing through vehicle axis 19. Thus, actuation of ram 52 causes crank arm 62 to rotate thus rotating drive shaft 64. A pair of drive gears 70, 72 are secured to drive shaft 64 for rotation therewith. Gears 70, 72 are connected to a lift shaft 74 through a pair of chains 76, 78. Chains 76, 78 are connected at their one ends to gears 70, 72 and at their other ends to gear segments 80, 82, segments 80, 82 being fixed to lift shaft 74.

Axis 84 of lift shaft 74 is parallel to vehicle axis 19. Therefore, drive axis 68 is perpendicular to a vertical plane passing through lift axis 84. To accommodate this, chains 76, 78 are directed past idler gears 86, 88. A transition link 90 is positioned along chains 76, 78 between idler gear 86 and gear segment 80 and between idler gear 88 and gear segment 82. An example of such a transition link is shown in U.S. Pat. No. 2,297,813 to Stork.

If ram 52 is actuated to rotate crank arm 62 counterclockwise as viewed in FIG. 5, then chain 78 is wound onto drive gear 72 and wound off of gear segment 82, this rotates lift shaft 74 in the direction of arrow 94. This causes lift arms 96, which extend from and are fixed to lift shaft 74, to also pivot in the direction of arrow 94. The outer ends 98 of lift arms 96 are pivotally mounted to supply hopper 18 at pivot points 100. Thus, rotation of lift shaft 74 in the direction of arrow 94 tends to raise supply hopper 18 from a lowered position of FIG. 4, to the raised, use position of FIG. 1.

The lowered position of FIG. 4 is used to resupply hopper 18 with material 15, typically from a dump truck. For stability, a pair of lower support arms 102 are pivotally mounted at their one ends to frame member 56 at pivots 104 and to supply hopper 18 adjacent bottom 24 at pivots 106. As shown in FIG. 4, arms 96, 102 are generally parallel. When arms 96 and 102 are pivoted in the direction of arrow 94, supply hopper 18 moves through the use position 108 of FIG. 1, to its raised, travel position 110.

Travel position 110 is such that supply hopper is past top dead center so the weight of hopper 18 when in position 110 tends to pivot the supply hopper in the direction of arrow 94. Having the travel position be beyond top dead center makes such position quite stable since movement of supply hopper 18 opposite arrow 94 can only occur by lifting the supply hopper past top dead center. Thus, even if pressurization is lost to ram 52, supply hopper 18 will tend to remain in position 110. To return supply hopper 18 to either raised, use position 108 or the lowered or fill position of FIG. 4, crank arm 62 is pivoted by ram 52 in a clockwise direction (FIG. 5). This causes drive gear 70 to pull on chain 76 so lift shaft 74 is rotated in the direction opposite arrow 94.

In use, operator 48 lowers supply hopper 18 to the fill position of FIG. 4. Hood 28 is opened allowing hopper 18 to be filled with material 15, typically from a dump truck. Hood 28 is then pivoted back into position covering paving material 15 and supply hopper 18 is moved, through actuation of ram 52, back to the raised, travel position 110 of FIG. 4. Material 15 is kept warm, if needed, by radiant panels 34. After reaching the work area, ram 52 is once again actuated to move supply hopper 18 from the raised, travel position 110 to the raised, use position 108, shown in FIG. 1. At this time, the operator manipulates arm 12 so to move distribution hopper 10 beneath discharge opening 46. Augers 40 are actuated to deposit a chosen amount of material 15 into distribution hopper 10. Hopper 10 is then moved to the appropriate position over surface 16 for the deposit of paving material 15 and the subsequent compaction by tamper 14.

Modification and variation can be made to the disclosed embodiment without departing from the subject of the invention as defined in the following claims. In the preferred embodiment both raised, travel and raised, use positions are provided for. If desired a single raised position for both travel and use, that is for the discharge of paving material 32 from hoppers 18 into distribution hopper 12, can be used. Flexible drive members other than chains 76, 78 can be used. Also, drive gears 70, 72 need not have teeth so long as the end of the respective chains 76, 78 are fastened to such drive elements.

I claim:

1. An improved pavement patching vehicle of the type including a movable distribution hopper for use with a patching material, the improvement comprising:

a supply hopper, mounted to the vehicle, having sidewalls for containing a supply of the patching material;

said supply hopper having a patching material discharge opening for discharging patching material from the supply hopper to the distribution hopper;

means for selectively delivering patching material from the supply hopper through the patching material discharge opening and to the distribution hopper; and means for movably mounting the supply hopper to the vehicle for movement between lowered and raised positions, the movably mounting means including a lift arm pivotally connected to the vehicle at its inner end, the lift arm pivotable about a lift arm axis, and a ram mounted to the vehicle, the ram operably coupled to a rotatable driver mounted to the vehicle for movement about a driver axis, the driver and lift arm axes being transverse to one another.

2. The vehicle of claim 1 further comprising radiant heat panels secured to the sidewalls for maintaining the patching material in the supply hopper at an elevated temperature.

3. The assembly of claim 1 wherein the driver axis is perpendicular to a vertical plane passing through the lift arm axis.

4. The vehicle of claim 1 wherein the supply hopper includes an open top, and further comprising a movable hood for covering the supply hopper top.

5. The vehicle of claim 4 further comprising radiant heat panels secured to the sidewalls and hood for keeping the patching material in the supply hopper at an elevated temperature.

6. The assembly of claim 1 wherein the delivering means includes first and second augers mounted within the supply hopper.

7. The assembly of claim 6 wherein the first and second augers have first and second flights, the first flight having a right hand twist and the second flight having a left-hand twist so to both mix and transport the patching material during delivery of the patching material through the patching material discharge opening and to the distribution hopper.

8. The assembly of claim 1 wherein said lift arm includes first and second lift arms spaced apart from one another.

9. The assembly of claim 8 further comprising first and second support arms connecting the vehicle and the supply hopper.

10. The assembly of claim 8 wherein the lift arm axes of the first and second lift arms are collinear.

11. The assembly of claim 10 wherein the first and second lift arms are mounted to a common, rotatable lift shaft.

12. The assembly of claim 1 wherein the rotatable driver is operably coupled to the lift shaft by a flexible connector having outer and inner ends.

13. The assembly of claim 12 wherein the flexible connector is a chain including an inner end, adapted for flexing about the lift arm axis, and an outer end, adapted for flexing about the drive axis.

14. The assembly of claim 12 wherein the rotatable driver includes a drive wheel drivingly coupled to the outer connector end, wherein the lift arm is mounted to a lift shaft for rotation therewith, and wherein inner connector end is connected to the lift shaft so to wrap about the lift shaft.

15. The assembly of claim 14 wherein the movably mounting means includes an idler between the drive wheel and the lift shaft for redirecting the flexible connector.

16. The assembly of claim 15 wherein the flexible connector is a chain.

17. The assembly of claim 16 wherein the movably mounting means includes a gear member secured to the lift shaft to which the inner end of the chain engages.

18. The assembly of claim 14 wherein the lift arm includes first and second lift arms mounted to the lift shaft.

19. The assembly of claim 18 wherein the drive wheel includes first and second drive wheels and the flexible connector includes first and second flexible connectors, the outer connector ends of first and second flexible connectors being drivingly coupled to the first and second drive wheels, and wherein the inner connector ends of the first and second flexible connectors are wrapped about the lift shaft in opposite directions.

20. The assembly of claim 19 wherein the first and second lift arms move past vertically upright positions when moving between the lowered and raised positions so that the raised position is a stable position.

21. An improved pavement patching vehicle of the type including a vehicle axis and a movable distribution hopper for use with patching material, the improvement comprising:

a supply hopper, for holding a supply of the patching material, including sidewalls, a movable hood and a patching material discharge opening;

radiant heating means mounted to the supply hopper for keeping the patching material at an elevated temperature;

means for transferring patching material to the patching material discharge opening for deposit into the distribution hopper;

a lift shaft, including a lift axis, mounted to the vehicle for rotation about the lift axis, the lift axis being parallel to the vehicle axis;

first and second lift arms, including inner and outer ends, pivotally mounted at their outer ends to the supply hopper, the lift arm inner ends secured to the lift shaft for movement therewith;

a support arm pivotally connected at its ends between the vehicle and the supply hopper;

a rotating drive member mounted to the vehicle for rotational movement about a drive axis, the drive axis being generally perpendicular to a vertical plane passing through the lift axis;

a ram mounted to the vehicle and operably connected to the rotating drive member; and first and second flexible connectors, each having inner and outer ends, the outer ends connected to the rotating drive member and the inner ends connected to the lift shaft, the flexible connector inner ends being wrapped about the lift shaft in opposite rotary directions so that the lift shaft is driven in the rotary direction corresponding to the direction of rotation of the drive member.

* * * * *